United States Patent [19]

Alig et al.

[11] Patent Number: 4,690,694

[45] Date of Patent: Sep. 1, 1987

[54] METHOD OF AUTOMATICALLY CONTROLLING AN ELECTROSTATIC PRECIPITATOR

[75] Inventors: Franz Alig, Johannesberg; Heinrich Böcker, Gründau; Franz Neulinger, Erzhausen; Helmut Schummer, Heusenstamm, all of Fed. Rep. of Germany

[73] Assignee: Metallgesellschaft Aktiengesellschaft, Frankfurt am Main, Fed. Rep. of Germany

[21] Appl. No.: 881,882

[22] Filed: Jul. 3, 1986

[30] Foreign Application Priority Data

Jul. 20, 1985 [DE] Fed. Rep. of Germany ..... 3526009

[51] Int. Cl.[4] ..... B03C 3/68

[52] U.S. Cl. ..... 55/4; 55/2; 55/105

[58] Field of Search ..... 55/2, 4, 105, 139

[56] References Cited

U.S. PATENT DOCUMENTS

| | | | |
|---|---|---|---|
| 4,209,306 | 6/1980 | Feldman et al. | 55/2 |
| 4,413,225 | 11/1983 | Donig et al. | 55/105 X |
| 4,522,635 | 6/1985 | Matts | 55/2 |

*Primary Examiner*—Kathleen J. Prunner

*Attorney, Agent, or Firm*—Sprung Horn Kramer & Woods

[57] ABSTRACT

In an electrostatic precipitator which is supplied with energy in the form of d.c. voltage pulses or of a d.c. voltage and superposed pulses, the energy supply is optimized and reverse corona discharges are avoided by use of a method in which energy at the highest possible rate is supplied to the electrostatic precipitator during the pulsing period and the total energy consumption of the electrostatic precipitator required to achieve in the pure gas a predetermined maximum dust content is minimized in that the pulse parameters are optimized and the application of pulses is interrupted for the longest possible non-pulsing time which is consistent with the predetermined maximum dust content of the pure gas.

12 Claims, 4 Drawing Figures a
0
100%
b
0
100%
S
c
0
100%
E

METHOD OF AUTOMATICALLY CONTROLLING AN ELECTROSTATIC PRECIPITATOR

BACKGROUND OF THE INVENTION

This invention relates to a method of optimizing the supply of energy to an electrostatic precipitator and of avoiding a reverse corona discharge in such precipitator, which is supplied with energy in the form of d.c. voltage pulses or of a d.c. voltage and superposed pulses.

In a known method of that kind, disclosed in Published German application No. 30 72 172, an electrostatic precipitator is energized with a variable d.c. voltage and superposed pulses in such a manner that the d.c. voltage and/or one of the parameters of the pulses are automatically varied in an iterative manner so that the sum of the electric energy supplied to the precipitator in the forn of the d.c. voltage and the pulses will be minimized whereas the dust content of the pure gas will be maintained at a predetermined mean value.

Published German Application No. 31 14 009 discloses an electrostatic precipitator in which dust is collected, in that a high d.c. voltage controlled by a thyristor is applied between the collecting electrodes and the corona electrodes. Besides, a control circuit is provided for an intermittent activation of the thyristors in such a manner that the repetition period and/or the pulse width of the high d.c. voltage can be manually or automatically adjusted. By means of that control circuit it is intended to improve the dust collection rate of the electrostatic precipitator particularly if the dust has a high resistivity in a range from $10^{11}$ to $10^{13}$ ohm-cm, in which an electrostatic precipitator normally does not operate satisfactorily owing to reverse corona discharges.

In the known control circuit the thyristor is controlled in such a manner that the high d.c. voltage is applied during a first interval of time $T_1$ of, e.g., 0.001 to 1 second and its application is interrupted for a second interval of time $T_2$ of, e.g., 0.01 to 1 second. The ratio of $T_1$ to $(T_1+T_2)$, i.e., of the pulsing time to the total of the pulsing and nonpulsing times, in each control cycle can be described as the k value. The entire method is described as a "control by means of semipulses".

A special object of the known method is to avoid reverse corona discharges, which are reflected in the current-voltage characteristics by a comparatively very steep rise of the current in response to an only slight increase of voltage. Such characteristics cause the electrostatic precipitator to have a high energy consumption whereas its dust collection rate is only low. Because the occurrence of reverse corona discharges is somewhat delayed relative to the rise of voltage or current caused by the conventional control, the occurrence of reverse corona discharges can be substantially suppressed by the method employing semipulses and an economical operation of the electrostatic precipitator can thus be achieved.

In accordance with the proposals discussed hereinbefore and other known proposals, the measures adopted for an improvement of the dust collection rate, on the one hand, and for an optimizing of the energy consumption, on the other hand, are not adequately distinguished from each other. In many cases reference is made to the optimizing of the dust collection rate although that requirement will generally make sense only if the energy consumption involved has no economic significance.

From the aspects of engineering and economy, the consideration must be based on a predetermined dust content of the pure gas and the electrostatic precipitator must be operated at a dust collection rate which will ensure that that predetermined dust content of the pure gas will be achieved with the lowest possible energy consumption. But even that requirement is not adequately specific for the operation of an electrostatic precipitator which is powered with pulsed energy. The collection of a dust particle from a gas stream will require in the first place that as many charge carriers as possible are introduced into the gas stream so that the dust particles will be effectively ionized, and in the second place that the dust particle which has been optimally ionized will travel an adequate distance transversely to the direction of flow to reach a collecting electrode during the time which is available for the passage of said ionized particle through the precipitator. Said two partial functions will be accomplished by the electrostatic precipitator if the corona electrodes and collecting electrodes are properly disposed and if the precipitator is strictly electrically controlled by pulses. The dust particles are ionized during the pulses and are collected on the collecting electrode during the non-pulsing times. For this reason the general requirement to minimize the energy consumption requires, in more specific language, that the energy supplied to the electrostatic precipitator during the pulsing times should be maximized whereas the total energy consumption should be minimized.

It is an object of the invention to optimize the energy supply in the sense stated above and to avoid reverse corona discharges in a method of the kind described first hereinbefore.

SUMMARY OF THE INVENTION

This object is accomplished in accordance with the invention in that the precipitator is energized in cycles, each of which comprises a pulsing time, in which at least one charging pulse is applied, and a non-pulsing time having a duration of a plurality of pulses, and the amplitude of the charging pulses (parameter a) in successive cycles is iteratively changed in such a manner that the time in which the voltage across the precipitator decays from a peak value U to a predetermined residual voltage $U_R$ is maximized.

The residual voltage $U_R$ is suitably controlled to be equal to the corona onset-voltage. In accordance with a preferred further feature of the invention the optimizing method can be further improved in that the application of charging pulses having an optimum amplitude is continued and the pulse width is iteratively changed in consecutive cycles in such a manner that the time in which the voltage across the precipitator decays from its peak value U to a predetermined residual voltage $U_R$ is maximized. If the application of charging pulses having an optimum amplitude and an optimum pulse width is continued, the number of charging pulses in each pulsing time may be increased by one pulse from each cycle to the next, and this increase of the number of pulses per pulsing time may be continued until the peak voltage applied to the precipitator is lower during the pulsing time of a given cycle than during the pulsing time of the immediately preceding cycle and the decay time is not shorter than the longest decay time which has been determined.

If an electrostatic precipitator is supplied with energy in the form of a d.c. voltage and superposed pulses, a plurality of pulses may be applied during each pulsing time. In that case the parameters which are iteratively varied comprise the amplitude of the charging pulses, the pulse duration, the number of charging pulses per pulsing time, and the pulse period of the charging pulses, and said parameters are varied so as to maintain a maximum decay time. Finally, the optimizing method may be repeatedly carried out for one or more of the parameters consisting of the charging pulse amplitude, the charging pulse width, the number of charging pulses per pulsing time, and the charging pulse period.

An important further improvement can be achieved by the method in accordance with the invention if the above-mentioned parameters are maintained at their optimum values and, when the voltage applied to the filter has decayed from its peak value U to the residual voltage $U_R$, a recharging voltage $U_N$, which is approximately as high as the residual voltage $U_R$, is maintained across the precipitator for a recharging time from the end of the decay time to the beginning of the next following pulsing time, and the recharging time is prolonged in consecutive cycles as long as the total energy consumption of the electrostatic precipitator decreases and the dust content of the pure gas remains below the predetermined desired value. If in that case a rise of the dust content of the pure gas above the desired value is detected even when the shortest possible recharging time is used, the optimizing method will suitably be repeated once or several times either in its entirety or in parts in such a manner that the residual voltage $U_R$ is increased in steps.

D.c. pulses may be applied to the electrostatic precipitator during the pulsing time and the recharging time, or a d.c. voltage and superposed pulses may be applied to the electrostatic precipitator at least during the pulse-applying time. A voltage pulse source operating at a pulse repetition frequency of 50 to 100 Hertz may be used to supply energy to the electrostatic precipitator. If the method is applied to an electrostatic precipitator having a plurality of separately controlled collecting fields, the method will suitably be carried out in such a manner that each collecting field is separately optimized and the fields are coordinated with each other.

Further details and advantages of the invention will be explained in more detail with reference to the drawings.

DETAILED DESCRIPTION OF THE INVENTION

Figure 1:
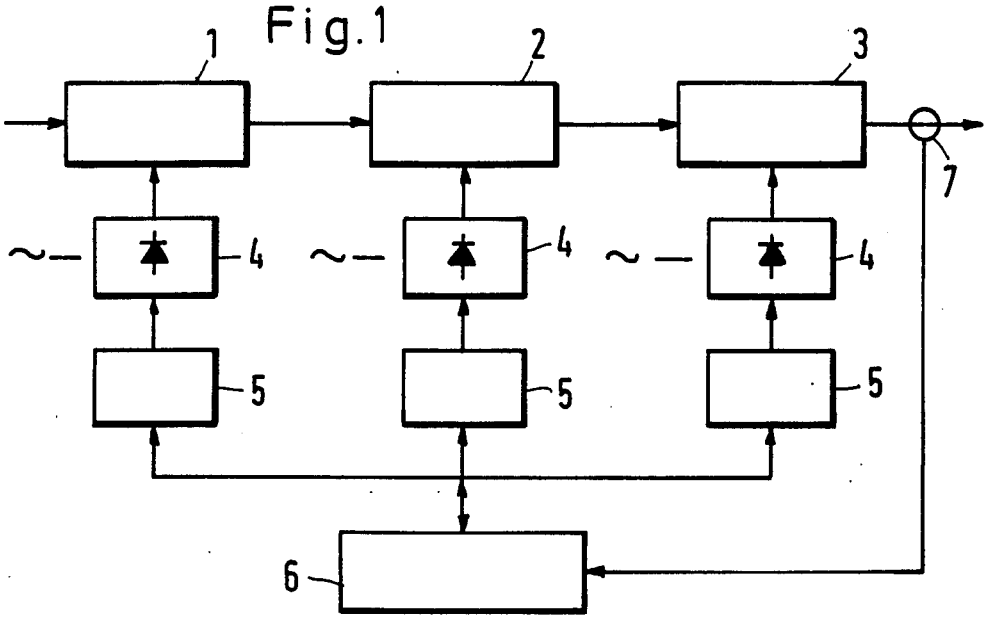
FIG. 1 is a highly simplified block circuit diagram of an electrostatic precipitator comprising three collection fields.

FIG. 1 shows an electrostatic precipitator comprising three zones or collecting fields 1, 2, 3. Said fields are flown through from the left to the right by a gas stream to be purified. Each of the collecting fields 1, 2, 3 has associated with it a separate power supply 4, which is fed with mains power and applies a high d.c. voltage to the associated collecting fields. Said power supplies are controlled by a microprocessor 5. An overriding control of the microprocessors 5 is effected by an optimizing computer 6, which receives from the sensor 7 a signal representing the dust content of the pure gas.

Figure 2:
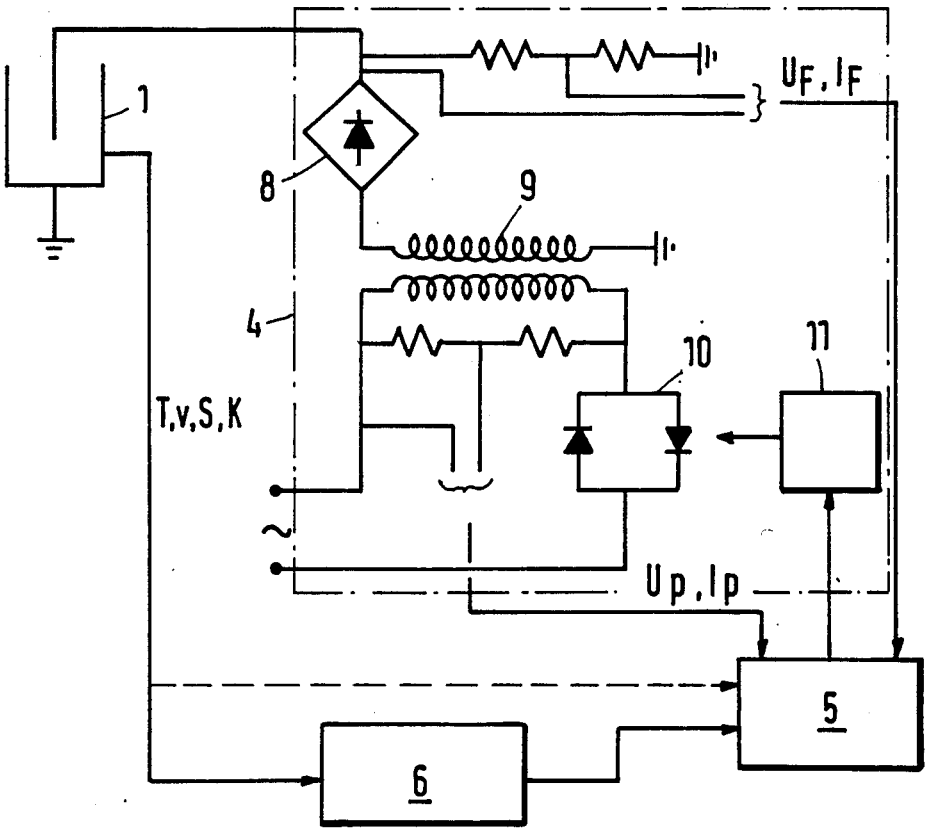
FIG. 2 is a simplified circuit diagram of a circuit for carrying out the invention.

As is apparent from FIG. 2, the power supply 4 enclosed by a dash-dot frame and serving to apply to the collection field a high d.c. voltage comprises a high-voltage rectifier 8, which is connected via a high-voltage transformer 9 and a thyristorized primary controller 10 to an a.c. power supply having a frequency of, e.g., 50 Hertz. The thyristors of the thyristorized primary controller are connected back to back and may be activated in such a manner that a predetermined number of consecutive half-waves of the a.c. voltage are blanked out and the precipitator is subsequently supplied with electric power for a predetermined number of half-waves. The circuit is so designed that the ratio of the pulsing time to the blanking or nonpulsing time can be adjusted between 1:50 and 50:1. In addition to that half-wave control, an amplitude control can be effected by a suitable phase control of the half-waves of the primary a.c. voltage. In this manner the amplitude of the charging pulses and the recharging voltage $U_N$ can be adjusted.

The thyristorized primary controller 10 receives control signals from a firing logic 11, which is activated by the micrprocessor controller 5. In the latter controller, signals representing the primary and secondary voltages $U_P$, $U_F$ and/or the primary and secondary currents $I_P$ and $I_F$ are processed to form control signals for the firing logic 11. As is indicated by the dotted line, the microprocessor controller 5 may also receive signals representing other measured values, such as the gas velocity the gas temperature T, the dust content S, the frequency K or the rapping steps, etc. But said parameters are normally delivered to the optimizing computer 6, which is also used to effect the iterative changes carried out in accordance with the invention in order to determine the optimum parameters for the operation.

Details of control systems of the kind mentioned hereinbefore have been described in more detail, inter alia, in European Pat. Nos. 30,320; 30,321; 31,056; 35,209; 28,505.

Figure 3:
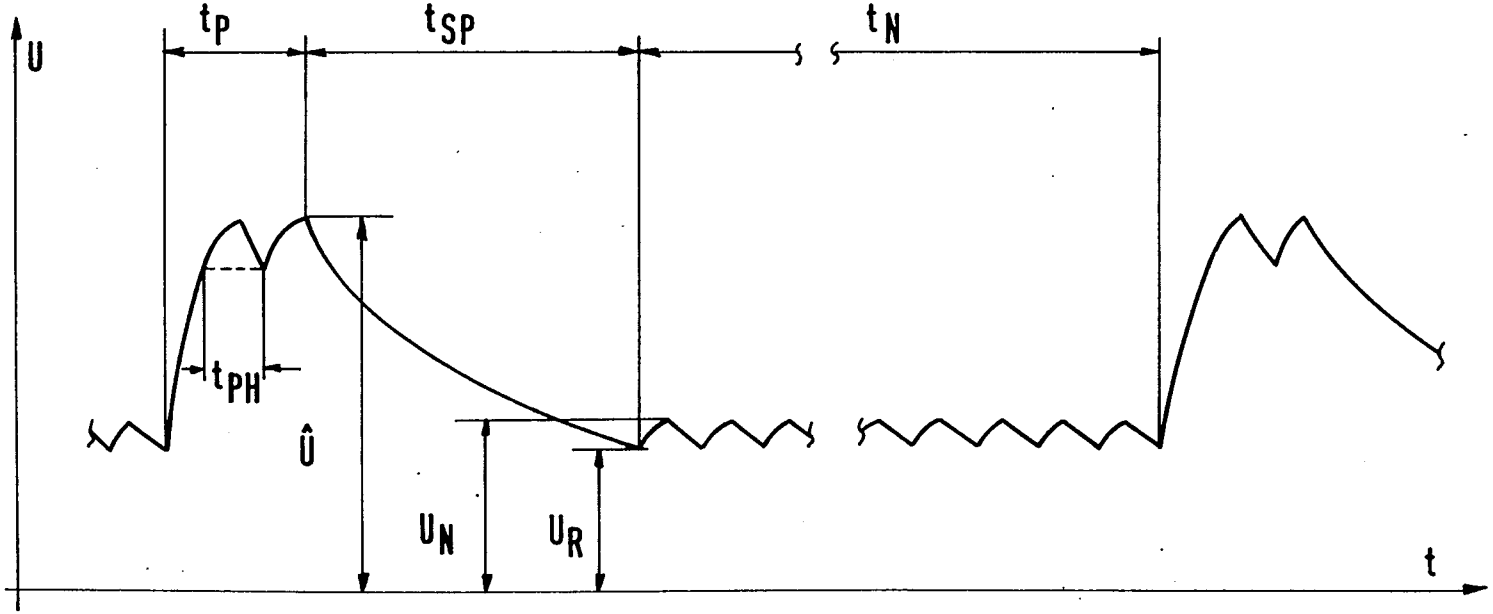
FIG. 3 is a graph in which the changing voltage across the precipitator in the method in accordance with the invention is plotted against time.

FIG. 3 is a graph plotting for the collection of high-resistivity dusts, the voltage across the precipitator against time during the performance of the method in accordance with the invention. The pulsing time $t_p$, which is represented here for two pulses having the amplitude U and the pulse width $t_{PH}$, is succeeded by the non-pulsing time $t_{SP}$ and this is followed by the recharging time $t_N$. The sum of said three times equals the duration of a cycle, which is succeeded by the next cycle, which will be carried out with the same times, amplitudes and pulse widths if the method has been perfectly optimized in accordance with the invention.

It will be understood that the compliance with that requirement is continually checked, for instance, in that the amplitude for the charging pulses is increased in steps whenever a predetermined time has expired, and it is then determined whether the time for the decay of the voltage across the percipitator from the peak value U to a predetermined residual voltage $U_R$ has reached its maximum or can be prolonged. Similarly, the parameters consisting of the pulse width, the number of charging pulses per charging interval, and the pulse period may be iteratively varied in order to determine the longest possible decay time. Because these checks may indicate that the parameters should be different from those used before, the method in accordance with the invention includes also a check whether the adjusted recharging time is still at its optimum. An indication that another iterative optimizing of the several parameters is called for may also be derived from the fact that certain parameters or measured values deviate more or less from the predetermined desired values.

From an electric aspect, similar voltage conditions across the electrostatic precipitator may be obtained if the blanking of half-waves of the primary voltage is replaced by the application of a d.c. voltage and of superposed pulses from a separate pulse voltage source. (See, e.g., Published German Application No. 30 72 171).

In a convenient practice of carrying out the method in accordance with the invention, a single charging pulse having an amplitude $U_1$ is applied first and it is checked how long it takes for the voltage across the filter to decay from the peak voltage U to the predetermined value $U_R$. In the next cycle, the amplitude of the charging pulse is increased to $U_2$ and the decay time then determined is compared with the decay time of the preceding cycle. If the decay time measured last is longer than the one measured before, the method will be continued with progressively higher amplitudes $U_3$, $U_4$, $U_5$, etc. until the decay time can no longer be increased. On the other hand, if the decay time is shorter in one cycle than in the immediately preceding cycle, the amplitude of the charging pulse will be decreased in steps until a decrease of the amplitude no longer results in a shorter decay time. In that way, it is always possible under changing operating conditions to determine that amplitude of the charging pulses which will result in an optimum decay time under changing operating conditions.

When the optimum amplitude of the charging pulses has been found, the other parameters, namely, the pulse width, the number of charging pulses and the pulse period, can be optimized. As a result, charge carriers in the largest possible number can be introduced into the collection field with the smallest possible consumption of energy under given conditions.

Within the scope of the invention that optimizing program can be further improved in that the application of charging pulses to the precipitator is not resumed as soon as the voltage across the filter has decayed to the predetermined value $U_R$ but a recharging voltage $U_N$, which is approximately as high as the residual voltage $U_R$, is maintained for a recharging time, and in consecutive cycles the recharging time is increased in steps as long as the total energy consumption of the collecting field decreases, whereas the dust content of the pure gas does not exceed the predetermined desired value. In that case the total energy consumptions of consecutive cycles including progressively increased recharging times are compared and the recharging time is prolonged as long as the energy consumption in a given cycle is less than in the immediately preceding cycle whereas the dust content of the pure gas is still below the predetermined desired value. When the dust content has reached the desired value, it will be apparent that the longest recharging time which can be adopted under the existing conditions has been achieved; this means that energy is consumed at the lowest rate which is consistent with the predetermined desired dust content of the pure gas.

Figure 4:
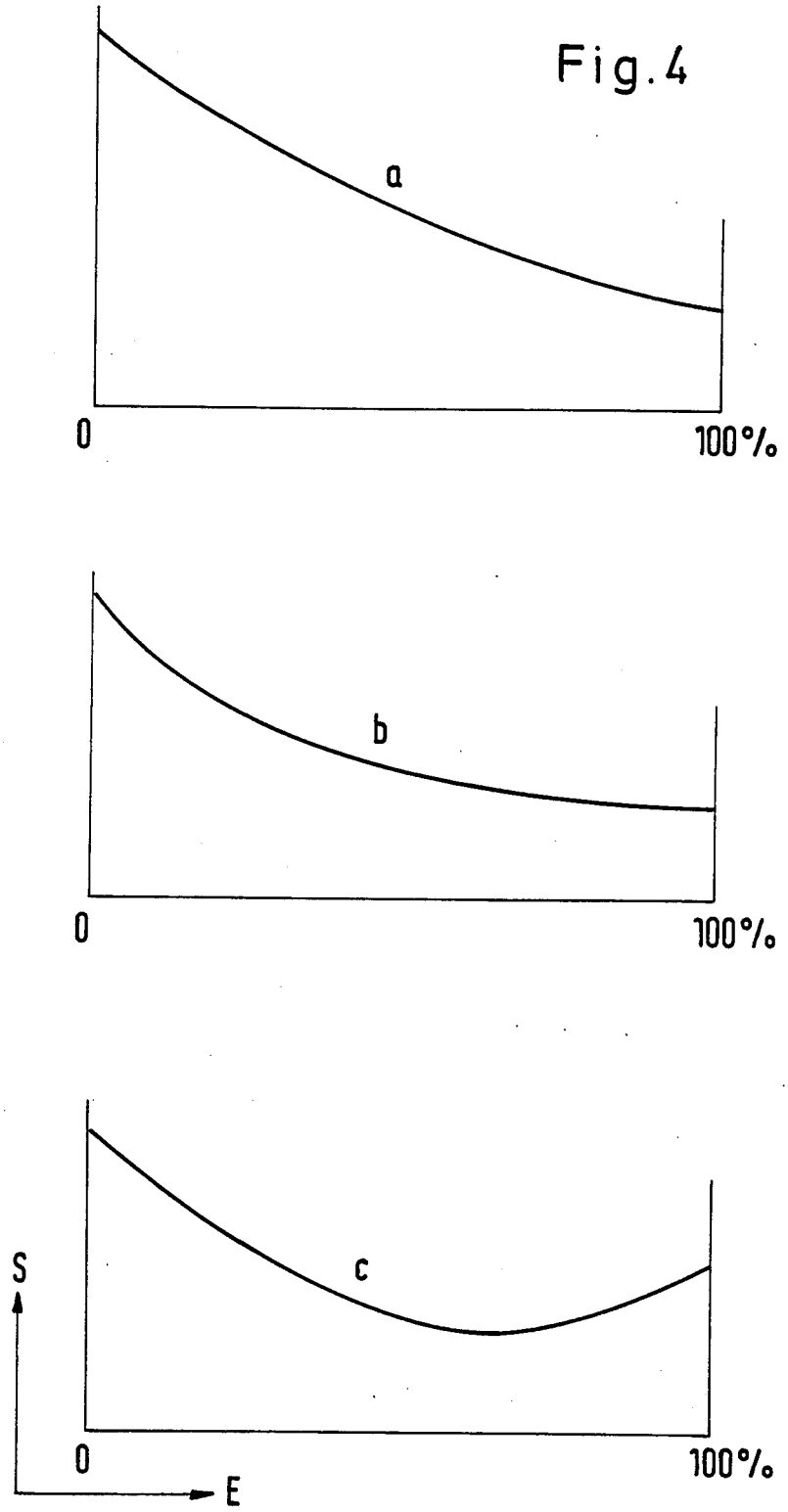
FIG. 4 shows typical curves plotting the dust content of the pure gas against the energy consumption for different dust resistivities.

For a further explanation of said relationships, reference is made to FIG. 4 showing typical curves in which the dust content E of the pure gas is plotted against the energy consumption E for different dust resistivities.

Curve a shows curves plotting the dust content of the pure gas for low dust resistivities. In general, a higher energy consumption will usually result in a lower dust content of the pure gas.

Curve b shows the curve for a dust resistivity of about $10^{11}$ ohm-cm, which is at the limit of the dust resistivities involving a risk of reverse corona discharges. In that case the dust content of the pure gas will initially decrease in proportion with the energy consumption and will then asymptotically decrease toward a minimum but will not fall below that minimum even if the plant has been designed for higher energy requirement. Curve c shows a typical curve for highly resistive dusts. In that case the minimum dust content of the pure gas will be achieved with an energy consumption below the maximum energy consumption for which the plant has been designed in view of the risk of reverse corona discharges.

The power supply means of plants for collecting highly resistive dusts are usually oversized because a number of unclear factors must be allowed for and it was not possible before to reliably determine the optimum mode of operation. The use of the method in accordance with the invention permits an electrostatic precipitator to be designed in closer approximation to the actual requirements and to be operated in an optimum manner.

It will be appreciated that the instant specification and claims are set forth by way of illustration and not limitation, and that various modifications and changes may be made without departing from the spirit and scope of the present invention.

What is claimed is:

1. A method of optimizing the supply of energy to an electrostatic precipitator and avoiding a reverse corona discharge in such precipitator, comprising the steps of: energizing the precipitator in cycles, each of which comprising a pulsing time, in which at least one charging pulse is applied, and a non-pulsing time having a duration of a plurality of pulses, and iteratively changing parameters of the charging pulses in successive cycles to maximize the time in which the voltage across the precipitator decays from a peak value to a predetermined residual voltage.

2. The method according to claim 1, wherein the residual voltage is controlled to be equal to the corona onset-voltage.

3. The method according to claim 1, wherein the amplitude of the charging pulses is iteratively changed until an optimum amplitude is reached wherein the time is maximized.

4. The method according to claim 3, wherein the application of charging pulses having an optimum amplitude is continued and the pulse width is iteratively changed in consecutive cycles until an optimum pulse width is reached wherein the time in which the voltage across the precipitator decays from its peak value to a predetermined residual voltage is maximized.

5. The method according to claim 4, wherein the application of charging pulses having an optimum amplitude and an optimum pulse width is continued, and the number of charging pulses in each pulsing time is increased by one pulse from each cycle to the next, and this increase of the number of pulses per pulsing time is continued until the peak voltage applied to the precipitator is lower during the pulsing time of a given cycle than during the pulsing time of the immediately preceding cycle and the decay time is not shorter than the longest decay time which has been determined.

6. The method according to claim 1, wherein the electrostatic precipitator is energized by a d.c. voltage and superposed pulses, a plurality of pulses are applied during each pulsing period and the parameters which are iteratively varied comprise the amplitude of the charging pulses, the pulse duration, the number of charging pulses per pulsing time, and the pulse period of the charging pulses and said parameters are varied so as to maintain a maximum decay time.

7. The method according to claim 6, wherein the optimizing method is repeatedly carried out for at least one of the parameters.

8. The method according to claim 7, wherein the parameters are maintained at their optimum values and, when the voltage applied to the filter has decayed from its peak value to the residual voltage, a recharging voltage, which is approximately as high as the residual voltage, is maintained across the precipitator for a recharging time from the end of the decay time to the beginning of the next following pulsing time, and the recharging time is prolonged in consecutive cycles as long as the total energy consumption of the electrostaic precipitator decreases and the dust content of the pure gas remains below the predetermined desired value.

9. The process according to claim 8, further comprising detecting a rise of the dust content of the pure gas above a desired value even when the shortest possible recharging time is used, and repeating the optimizing method at least once at least in part such that the residual voltage is increased in steps.

10. The method according to claim 9, wherein d.c. pulses are applied to the electrostatic precipitator during the pulsing time and any recharging time.

11. The method according to claim 9, characterised in that a d.c. voltage and superposed pulses are applied to the electrostatic precipitator at least during the pulsing time.

12. The method according to claim 11, for controlling an electrostatic precipitator having a plurality of separately controlled collecting fields separately optimizing each collecting field and coordinating the collecting fields with each other.

* * * * *